United States Patent [19]

Hyodo

[11] 3,979,570

[45] Sept. 7, 1976

[54] SWITCHING APPARATUS

[75] Inventor: Masayoshi Hyodo, Toyota, Japan

[73] Assignee: Kabushiki Kaisha Tokai Rika Denki Seisakusho, Japan

[22] Filed: May 14, 1974

[21] Appl. No.: 469,712

[30] Foreign Application Priority Data

May 16, 1973 Japan ..... 48-58022[U]
May 16, 1973 Japan ..... 48-58023[U]

[52] U.S. Cl. ..... 200/264; 200/159 B
[51] Int. Cl.[2] ..... H01H 35/38
[58] Field of Search ..... 200/264, 159 B, 159 R; 338/100, 114, 118, 2

[56] References Cited

UNITED STATES PATENTS 3,509,296 4/1970 Harshman et al. ..... 200/159 R
3,758,733 9/1973 Durocher, et al. ..... 200/264 X
3,839,694 10/1974 DuRocher et al. ..... 338/114 X

*Primary Examiner*—Herman J. Hohauser
*Attorney, Agent, or Firm*—Pollock, Vande Sande & Priddy

[57] ABSTRACT

An on-off switch comprising a contact element of conductive elastomeric material for establishing a current path between a pair of terminals, a movable member for imparting a compressing force to the contact element, and an actuator for actuating the movable member. When the movable member is actuated by the actuator to compress the contact element, the contact element is rendered electrically conductive to electrically connect the terminals with each other thereby turning on the switch.

4 Claims, 9 Drawing Figures

SWITCHING APPARATUS

BACKGROUND OF THE INVENTION

This invention relates to improvements in switching apparatus, and more particularly to improvements is a switching apparatus of the kind which makes on-off of an electrical circuit.

The switching apparatus of the present invention is a switch of the type which turns on and off an electrical connection between two or more terminals by a movable member which is mechanically actuated. A variety of switches of such a type are commonly known. In a conventional switch structure of this type, the movable member acts as a moving contact, and the switch is placed in the on position when the moving contact is brought into contact with the terminals, while the switch is placed in the off position when the moving contact is moved away from the terminals. This switch structure has not been suitable for applications in which the frequency of on-off manipulation is quite high. That is, this switch structure has been defective in that the service life of the switch is relatively short for the reasons that permanent deformation due to fatigue occurs in the moving contact during repeated use and that an arc jumps across the moving contact and the terminals when the switch is turned off. Another serious defect of the conventional switch has been the fact that the switching action cannot be reliably attained when the moving contact is mounted in an incorrect position during assembling. This fact has also demanded machining and assembling of high precision for the switching apparatus.

SUMMARY OF THE INVENTION

It is a primary object of the present invention to provide a switching apparatus in which the on-off operation between terminals is attained by a contact element of conductive elastomeric material.

Another object of the present invention is to provide a switching apparatus which comprises a contact element of conductive elastomeric material, and a movable member actuated by an actuating means for imparting a compressing force to the contact element.

Still another object of the present invention is to provide a switching apparatus which comprises a contact element of conductive elastomeric material, a movable member for imparting a compressing force to the contact element, and a fluid-operated actuating means for actuating the movable member.

Yet another object of the present invention is to provide a switching apparatus which comprises a contact element of conductive elastomeric material, a movable member for imparting a compressing force to the contact element, an actuating means incorporated in a switch casing for actuating the movable member, and a holder of electrical insulator mounted on the switch casing and having a plurality of terminals therein.

DESCRIPTION OF THE PREFERRED EMBODIMENTS

Figure 1:
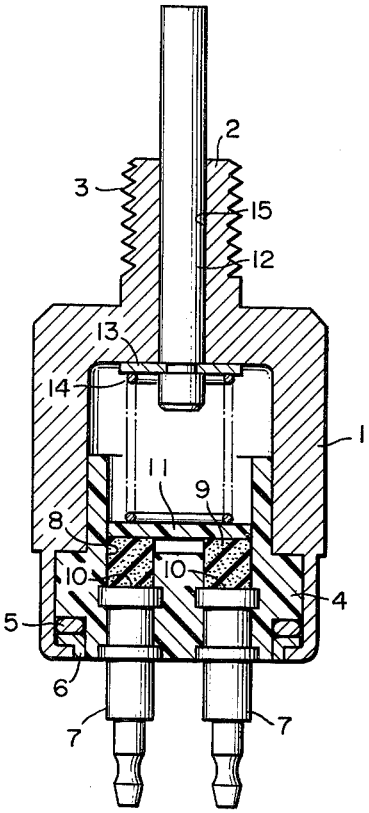
FIG. 1 is a longitudinal sectional view of a first embodiment of the present invention in the off state.
Figure 2:
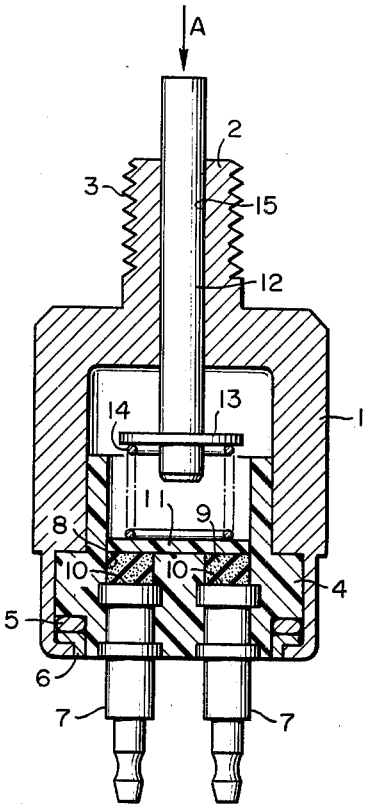
FIG. 2 is a longitudinal sectional view similar to FIG. 1, but showing the apparatus in the on state.
Figure 3:
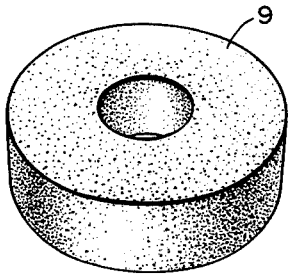
FIG. 3 is a perspective view of the contact element employed in the apparatus shown in FIG. 1.

FIGS. 1, 2 and 3 show a first embodiment of the present invention which is suitable for use as a back light switch in an automobile.

Referring to FIG. 1, a switch casing 1 of metal material has a cylindrical extension 2 formed integrally therewith, and this cylindrical extension 2 is externally threaded at a portion 3 of the outer periphery thereof. The switch casing 1 is fixed at a suitable position in the vicinity of the transmission of a vehicle. A holder 4 of electrical insulator is inserted into the opening of the switch casing 1 and is firmly secured in position within the switch casing 1 by an O-ring 5 and a flange 6 which is bent into an L-like sectional shape. A pair of spaced terminals 7 are embedded in the holder 4 to be firmly held in the spaced position relative to each other, and a pair of known leads (not shown) are connected to these terminals 7 to constitute a back light circuit.

An annular groove 8 is formed in the holder 4 to expose the electrode surfaces 10 of the terminals 7, and an annular contact element 9 of conductive elastomeric material as shown in FIG. 3 is loosely fitted in this groove 8. The thickness of the contact element 9 is selected to be greater than the depth of the groove 8, and the contact element 9 is in contact with the electrode surfaces 10 of the terminals 7 at one end thereof and protrudes from the groove 8 at the other end portion thereof. The contact element 9 is made by dispersing fine particles of conductive metal in a mass of non-conductive elastomer such as porous or non-porous silicone rubber. This element 9 shows a substantially infinite high electrical resistance in a non-compressed state as shown in FIG. 1, but with impartation of a compressing force to the element 9, the elastomer is compressed as shown in FIG. 2 and the fine metal particles are brought into contact with one another to render the element 9 electrically conductive.

A disc-shaped movable member 11 of electrical insulator is disposed to engage the contact element 9 and is arranged to move relative to the contact element 9 to impart a compressing force to the contact element 9. An actuator is mounted in the switch casing 1 for causing the movement of the movable member 11. This actuator comprises a push rod 12, a flange 13 and a spring 14. The push rod 12 extends slidably through the opening 15 of the cylindrical extension 2 of the switch casing 1 and is connected at one end thereof to the change lever (not shown) of the vehicle so that the push rod 12 can be pushed in a direction as shown by the arrow A in FIG. 2 when the change lever is shifted to the back position. The flange 13 is fixed to the other end of the push rod 12 to move with the push rod 12, and this movement of the flange 13 is transmitted to the movable member 11 through the spring 14 interposed between the flange 13 and the movable member 11.

The first embodiment operates in a manner as described below. In FIG. 1 in which the change lever is in the forward position, the biasing force of the spring 14 is substantially zero and no pressure is imparted to the contact element 9. Therefore, the fine metal particles dispersed within the contact element 9 are out of contact with one another, and the contact element 9 is non-conductive. As a result, the back light circuit including the terminals 7 is open and the back light is turned off. When the change lever is changed to the back position, the push rod 12 is urged in the direction of the arrow A in FIG. 2 to impart pressure to the movable member 11 through the spring 14 with the result that the contact element 9 is compressed by the movable member 11. The fine metal particles dispersed within the contact element 9 are brought into contact with one another to render the contact element 9 electrically conductive. Thus, the terminals 7 are electrically connected with each other by the contact element 9 and the back light is energized. When the change lever is shifted from the back position to any other position and the push rod 12 is returned to the position shown in FIG. 1 again, the compressing force having been imparted to the contact element 9 is released and the contact element 9 is restored to the original non-conductive state by the own resiliency thereof thereby deenergizing the back light.

This switching apparatus employing the contact element of conductive elastomeric material is advantageous in that any substantial arc is not produced during circuit breaking operation, and generation of heat at the contact portions and burn of the electrode surfaces can be prevented. Further, the mechanical precision demanded for various parts of the switching apparatus is not so severe due to the fact that the contact element provides sufficiently satisfactory conductivity regardless of slight variations in the compressing force provided that the compressing force imparted to the contact element is more than a certain limit.

Figure 4:
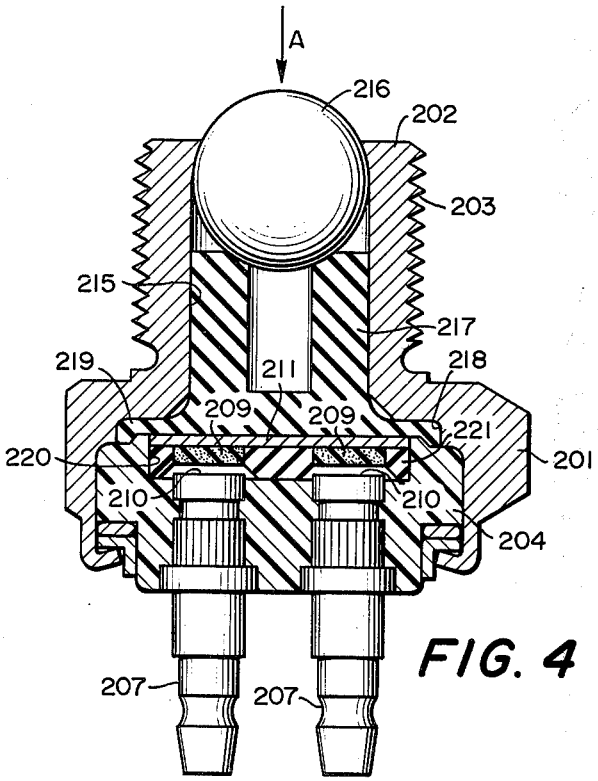
FIG. 4 is a longitudinal sectional view of a second embodiment of the present invention.

FIG. 4 shows a second embodiment of the present invention. Referring to FIG. 4, a cylindrical extension 202 having an externally threaded portion 203 is formed as an integral part of a switch casing 201. A holder 204 of electrical insulator having a pair of spaced terminals 207 fixedly embedded therein is firmly mounted as by caulking in the opening of the switch casing 201. The inner wall at the outer end portion of the central opening 215 of the cylindrical extension 202 of the switch casing 201 is shaped into the form of a partial sphere, and a ball 216 is fitted in this outer end portion of the central opening 215 with a portion thereof projecting outwardly from such end portion. A pressure imparting member 217 of elastic material such as rubber is mounted in the central opening 215 and engages at one end thereof with the ball 216. The ball 216 and pressure imparting member 217 constitute an actuator for a movable member 211 which is made of a conductive material.

The pressure imparting member 217 is formed with a flange 219 which is held between the holder 204 and a shoulder 218 of the switch casing 201. The holder 204 is provided with a circular recess 220 opposite to the pressure imparting member 217 so that the electrode surfaces 210 of the terminals 207 can be exposed in this recess 220. A resilient member 221 of elastic electrical insulator such as rubber is received in the recess 220 and supports therein a pair of spaced contact elements 209 of conductive elastomeric material which are slightly spaced from the electrode surfaces 210 of the associated terminals 207. The movable member 211 of conductive material is interposed between the pressure imparting member 207 and the contact elements 209.

This embodiment operates in a manner as described below. In response to the impartation of an actuating force to the ball 216 in a direction as shown by the arrow A, the pressure imparting member 217 of rubber is urged in the same direction while being slightly compressed and compresses the resilient member 221 and contact elements 209 through the movable member 211. As a result, the contact elements 209 are rendered electrically conductive, and at the same time, pressed against the electrode surfaces 210 of the associated terminals 207, and these contact elements 209 cooperate with the movable member 211 of conductive material to electrically connect the terminals 207 with each other to turn on the switch.

Figure 5:
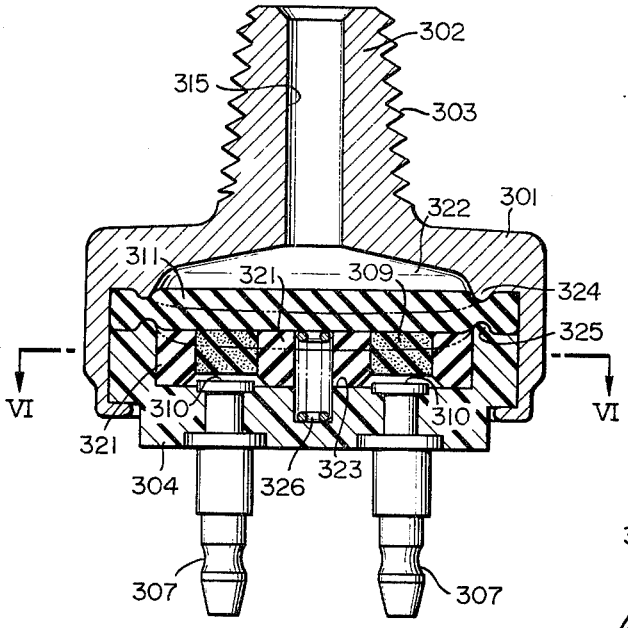
FIG. 5 is a longitudinal sectional view of a third embodiment of the present invention.
Figure 6:
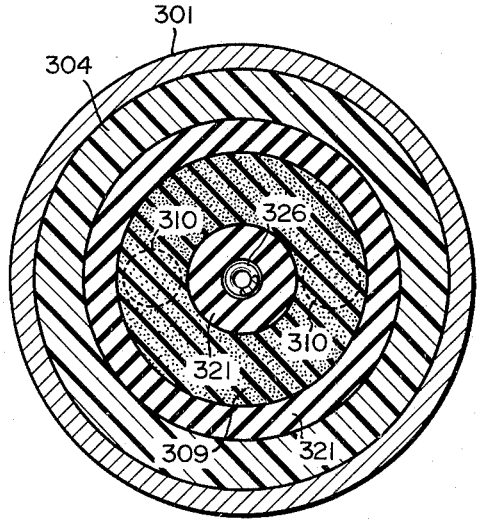
FIG. 6 is a section taken on the line VI—VI in FIG. 5.

FIGS. 5 and 6 show a third embodiment of the present invention in which a fluid-operated actuator is used to actuate a movable member. Referring to FIGS. 5 and 6, an extension 302 having an externally threaded portion 303 is formed integrally with a switch casing 301. A holder 304 of electrical insulator having a pair of spaced terminals 307 fixedly embedded therein is firmly mounted as by caulking in the opening of the switch casing 301. A fluid reserving space 322 in the switch casing 301 communicates with a source of fluid pressure through a communication passage 315 bored in the extension 302. This communication passage 315 forms a part of a fluid-operated actuator. The holder 304 is provided with a recess 323, and a pair of spaced easily compressible annular resilient rings 321 of electrical insulator such as porous rubber are received in this recess 323. An annular contact element 309 of conductive elastomeric material is disposed between these resilient rings 321. The shape of the contact element 309 used in this embodiment is analogous to that of the contact element 9 shown in FIG. 3. In the mounted state shown in FIG. 5, the contact element 309 is slightly spaced from the electrode surfaces 310 of the terminals 307. A diaphragm 311 acting as a movable member is normally held between an annular projection 324 of the switch casing 301 and a corresponding annular projection 325 of the holder 304. A compression spring 326 in interposed between the diaphragm 311 and the holder 304 so as to normally maintain the diaphragm 311 in the position shown by the solid lines in FIG. 5 when no actuating force of the fluid is imparted to the diaphragm 311.

FIG. 5 shows the state of the switching apparatus when no fluid pressure is imparted to the diaphragm 311 by the fluid-operated actuator. The contact elements 309 are non-conductive since no compressing force is imparted thereto, and there is no electrical connection between the terminals 307 since the contact element 309 is out of contact with the electrode surfaces 310 of the terminals 307. When a fluid pressure higher than a predetermined setting is imparted to the diaphragm 311 through the communication passage 315 communicating with the source of fluid pressure, the diaphragm 311 is subjected to elastic deformation as shown by the two-dot chain lines in FIG. 5 to impart a compressing force to the resilient rings 321 and contact element 309. As a result, the contact element 309 is brought into contact with the electrode surfaces 310 of the terminals 307, and at the same time, the contact element 309 is rendered electrically conductive. Thus, the terminals 307 are electrically connected with each other to turn on the switch.

Figure 7:
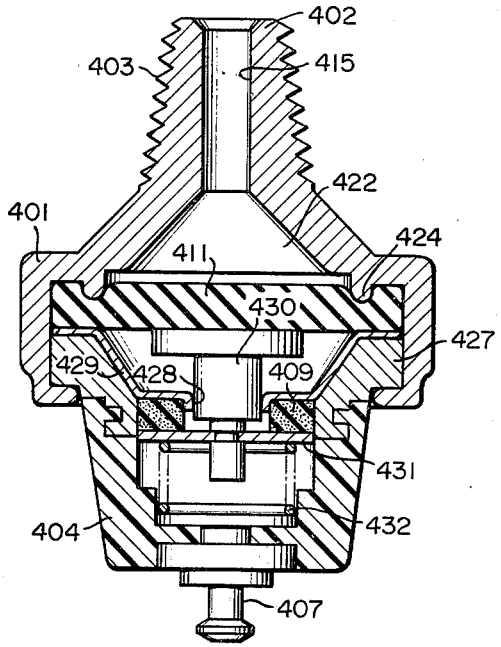
FIG. 7 is a longitudinal sectional view of a fourth embodiment of the present invention.
Figure 8:
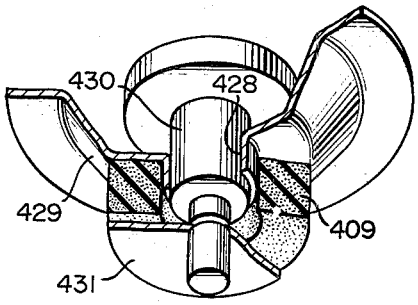
FIG. 8 is a partly cut-away perspective view showing the relation between the contact element and the slider employed in the apparatus shown in FIG. 7.

FIGS. 7 and 8 show a fourth embodiment of the present invention in which terminals are normally electrically connected with each other unless an actuating force of fluid is imparted. A switch casing and a diaphragm in this embodiment are similar to those employed in the third embodiment and are designated by adding 100 to the reference numerals of the corresponding parts in the third embodiment. It is apparent that any detailed description as to such parts is unnecessary.

A cover 427 of metal material is secured as by caulking to the switch casing 401, and a generally cup-shaped electrode plate 429 having a tubular opening 428 is held between this cover 427 and a diaphragm 411. A holder 404 of electrical insulator having a terminal 407 fixedly embedded therein is secured to the cover 427. A slider 430 is slidably received in the tubular opening 428 of the electrode plate 429. One end of the slider 430 engages the diaphragm 411 and a washer 431 is fixed to the other end of the slider 430. A contact element 409 of conductive elastomeric material is disposed between the washer 431 and the electrode plate 429, and the washer 431 is normally urged upward in FIG. 7 by the force of a spring 432.

In the state in which no fluid pressure is imparted to the diaphragm 411 through a fluid passage 415 and a fluid reserving space 422, the contact element 409 is compressed by the spring 432 and washer 431 and is electrically conductive. In this state, the terminal 407 is electrically connected to the electrode plate 429 by the contact element 409, spring 432 and washer 431 to turn on the switch. When the diaphragm 411 is elastically deformed downward in FIG. 7 within the switch casing 401 by fluid pressure imparted thereto, the slider 430 forces the washer 431 downward against the force of the spring 432 and the contact element 409 is released from the compressed state thereby turning off the switch.

Figure 9:
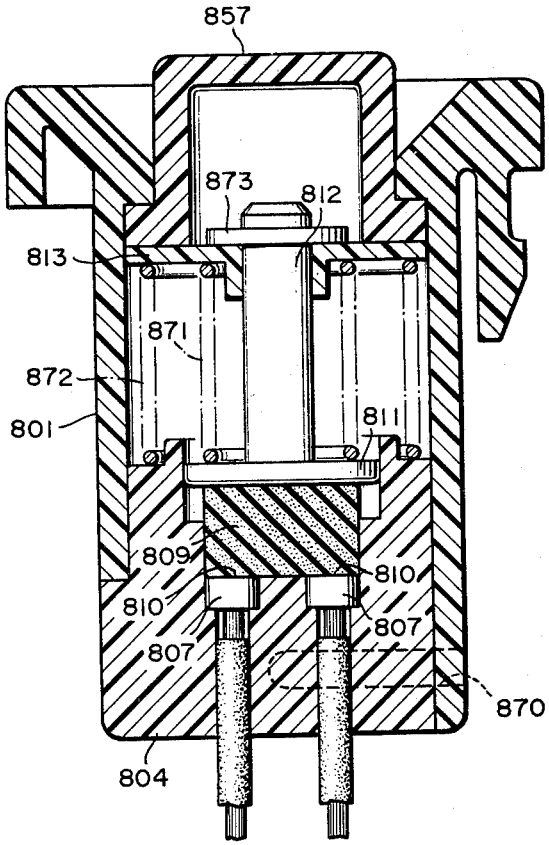
FIG. 9 is a longitudinal sectional view of an fifth embodiment of the present invention.

FIG. 9 shows a fifth embodiment of the present invention.

Referring to FIG. 9, a holder 804 of electrical insulator is firmly secured in position within a switch casing 801 of electrical insulator by a pin 870. A contact element 809 of conductive elastomeric material is loosely fitted in the holder 804, and the contact element 809 is in contact with an electrode surface 810 of terminals 807. A movable member 811 forming integrally with a push rod 812 is disposed to engage the contact element 809. In this embodiment, an actuator for causing the movement of the movable member 811 comprises a flange 813, springs 871, 872 and a push button 857. The flange 813 is slidably arranged to the push rod 812, and is moved by the push button 857 slidably mounted in the switch casing 801. A stopper 873 is fixed to the end of the push rod 812 for engagement to the flange 813. The movement of the flange 813 is transmitted to the movable member 811 through the spring 871 interposed between the flange 813 and the movable member 811. The auxiliary spring 872 is interposed between the flange 813 and the holder 804.

I claim:

1. A switching apparatus comprising:

a switch casing, a plurality of terminals connected to an electric circuit, a holder of electrical insulating material fixedly supporting at least one of said terminals, at least one contact element of conductive elastomeric material disposed to be engageable with said terminals, a movable member for imparting a compressing force to said contact element, and actuating means disposed in said switch casing for actuating said movable member, said holder being firmly secured to said switch casing, said actuating means comprising a fluid-operated actuator including a fluid passage and a fluid reserving space formed in said switch casing for communication with a source of fluid pressure, said contact element being normally compressed by the force of a spring so that said contact element is electrically conductive when said fluid-operated actuator is not in operation, and said diaphragm acting to release said contact elememt from the compressed state through a slider against the force of said spring when said fluid operated actuator is placed in operation.

2. A switching apparatus as claimed in claim 1, wherein a slider constituting a part of said actuating means is slidably mounted in said switch casing and carries said movable member at one end thereof, and said terminals are firmly secured to said holder.

3. A switching apparatus as claimed in claim 1, wherein said contact element is fixed to a flexible strip of electrical insulator which is flexibly supported in said switch casing.

4. A switching apparatus as claimed in claim 1, wherein said contact element is directly fixed to said movable member.

* * * * *